US010087878B2

(12) United States Patent
McDowell

(10) Patent No.: US 10,087,878 B2
(45) Date of Patent: Oct. 2, 2018

(54) CYLINDER HEAD COVER WITH INTEGRAL SLEEVE

(71) Applicant: General Electric Company, Schenectady, NY (US)

(72) Inventor: Robert Earl McDowell, Waukesha, WI (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 119 days.

(21) Appl. No.: 14/847,904

(22) Filed: Sep. 8, 2015

(65) Prior Publication Data

US 2017/0067412 A1 Mar. 9, 2017

(51) Int. Cl.

| | |
|---|---|
| ***F02F 7/00*** | (2006.01) |
| ***F02M 25/00*** | (2006.01) |
| ***F02F 1/42*** | (2006.01) |
| ***F02F 1/24*** | (2006.01) |
| *H01T 13/08* | (2006.01) |

(52) U.S. Cl.

CPC ..... *F02F 1/242* (2013.01); *F02F 7/006* (2013.01); *H01T 13/08* (2013.01)

(58) Field of Classification Search

CPC .... F02F 1/242; F02F 7/006; F02F 1/26; F02F 35/10288; H01T 13/08

USPC ..... 123/193.5, 195 C, 198 E

See application file for complete search history.

(56) References Cited

U.S. PATENT DOCUMENTS

| | | | | |
|---|---|---|---|---|
| 4,727,833 | A * | 3/1988 | Nakashima | F02F 1/242 123/195 C |
| 8,745,987 | B2 | 6/2014 | Stoia et al. | |
| 2002/0157629 | A1* | 10/2002 | Inagaki | F01L 1/14 123/90.48 |
| 2002/0162545 | A1* | 11/2002 | Weingaertner | F02M 67/06 123/568.15 |
| 2003/0213453 | A1* | 11/2003 | Matsuda | F02F 1/242 123/169 PA |

FOREIGN PATENT DOCUMENTS

JP 5099112 * 4/1993

OTHER PUBLICATIONS

Waukesha, Cylinder Head Overhaul Procedures, Oct. 15, 2008, Dresser, Inc., Waukesha, WI.

Waukesha, Cylinder Head Overhaul Procedures, May 27, 2011, Dresser, Inc., Waukesha, WI.

U.S. Appl. No. 14/629,717, filed Feb. 24, 2015, Nazar Ahmed Elwasila.

U.S. Appl. No. 14/459,943, filed Aug. 14, 2014, Julian Knudsen.

* cited by examiner

*Primary Examiner* — Syed O Hasan

(74) *Attorney, Agent, or Firm* — Fletcher Yoder, P.C.

(57) ABSTRACT

A system includes a cylinder head for a reciprocating engine and a cylinder head cover configured to couple to the cylinder head. The cylinder head cover may include an ignition plug sleeve extension configured to house a portion of an ignition plug within the cylinder head cover. The ignition plug sleeve extension is integral to the cylinder head cover.

20 Claims, 4 Drawing Sheets

CYLINDER HEAD COVER WITH INTEGRAL SLEEVE

BACKGROUND

The subject matter disclosed herein relates to reciprocating engines and, more specifically, to a cylinder head cover.

A reciprocating engine (e.g., an internal combustion engine such as a diesel engine or gas engine) combusts fuel with an oxidant (e.g., air) in a combustion chamber to generate hot combustion gases, which in turn drive a piston (e.g., reciprocating piston) within a cylinder. In particular, the hot combustion gases expand and exert a pressure against the piston that linearly moves the position of the piston from a top portion to a bottom portion of the cylinder during an expansion stroke. The piston converts the pressure exerted by the hot combustion gases (and the piston's linear motion) into a rotating motion (e.g., via a connecting rod and a crankshaft coupled to the piston) that drives one or more loads, for example, an electrical generator. A cylinder head is generally at a top of the cylinder, above the piston and other components of the cylinder. The cylinder head may include an opening for an ignition plug (e.g., a spark plug), which is configured to ignite the fuel and oxidant in the combustion chamber. A cylinder head cover (or cylinder valve cover) may be coupled to the cylinder head to protect the cylinder head and its components from outside debris. Unfortunately, traditional cylinder head covers may leak and may cause complications with sealing through the cylinder head cover.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In a first embodiment, a system includes a cylinder head for a reciprocating engine, and a cylinder head cover configured to couple to the cylinder head. The cylinder head cover includes an ignition plug sleeve extension configured to house a portion of an ignition plug within the cylinder head cover. The ignition plug sleeve extension is integral to the cylinder head cover.

In a second embodiment, a cylinder head cover is configured to couple to a cylinder head of a reciprocating engine. The cylinder head cover includes an ignition plug sleeve extension that forms an inner annular wall within the cylinder head cover that is configured to house a portion of an ignition plug within the cylinder head cover. The ignition plug sleeve extension and the cylinder head cover are a single piece.

In a third embodiment, a method includes casting a cylinder head cover for coupling to a cylinder head, such that the cylinder head cover includes an ignition plug sleeve extension that houses a portion of an ignition plug within the cylinder head cover, and the ignition plug sleeve extension is integral to the cylinder head cover.

BRIEF DESCRIPTION OF THE DRAWINGS

These and other features, aspects, and advantages of the present subject matter will become better understood when the following detailed description is read with reference to the accompanying drawings in which like characters represent like parts throughout the drawings, wherein.

DETAILED DESCRIPTION

Figure 1:
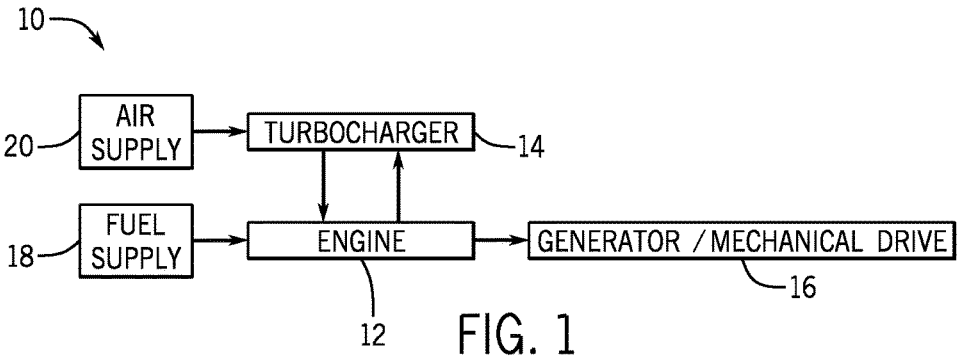
FIG. 1 is a block diagram of an embodiment of an engine driven power generation system.

One or more specific embodiments of the present subject matter will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present subject matter, the articles "a," "an," "the," and "said" are intended to mean that there are one or more of the elements. The terms "comprising," "including," and "having" are intended to be inclusive and mean that there may be additional elements other than the listed elements.

The present disclosure is directed to systems for components of reciprocating engines and, more specifically, a cylinder head cover (or cylinder valve cover) of the reciprocating engine. In particular, embodiments of the present disclosure include a reciprocating engine that includes a cylinder, a cylinder head, and a cylinder head cover disposed on the cylinder head. The cylinder head cover includes an integral ignition plug sleeve extension (e.g., as a single structure with the cylinder head cover) for receiving an ignition device (e.g., spark plug, ignition plug, or glow plug) of the reciprocating engine. The integral ignition plug sleeve extension of the cylinder head cover may define an inner annular wall of the cylinder head cover which is centrally located within the cylinder head cover. The inner annular wall may define an opening or bore in which the ignition device (e.g., spark plug, ignition plug, or glow plug) rests. In accordance with embodiments of the present disclosure, a portion of the inner annular wall extends into the cylinder head. The inner annular wall may define a first bore portion with a first inner diameter, and a second bore portion with a second inner diameter. The first inner diameter may be greater than the second inner diameter portion, thus, forming an annular shoulder for the ignition device to be disposed on. An ignition plug sleeve within the cylinder head and the ignition plug sleeve extension may contact each other directly to form an interface between the cylinder head cover and the cylinder head.

Including the ignition plug sleeve extension as set forth above may enable a number of advantages over configurations that include a separate ignition plug sleeve extension (e.g., a spark plug sleeve extension separate from, and inserted into, the cylinder head cover). For example, by incorporating the ignition plug sleeve extension into the cylinder head cover (e.g., by casting a single piece that includes the plug sleeve extension within the cylinder head cover), cost and manufacturing difficulties may be substantially reduced due to the reduced number of parts. The integral cylinder head cover and ignition plug sleeve extension may reduce potential leakage paths for hot gases from the cylinder and/or cylinder head to leak through. The integral cylinder head cover and ignition plug sleeve extension may also improve sealing between the cylinder head and the cylinder head cover due to the increased surface area of the cylinder head cover that contacts the cylinder head when the cylinder head cover is coupled (e.g., via bolted connections) to the cylinder head.

Turning now to the drawings and referring first to FIG. 1, a block diagram of an embodiment of an engine driven power generation system 10 is illustrated. As described in detail below, the disclosed engine driven power system 10 utilizes an engine 12 that includes a cylinder head cover coupled to the cylinder head, wherein the cylinder head cover includes an ignition plug sleeve extension, integral to the cylinder head cover (i.e., formed as a single piece). The integral ignition plug sleeve extension may be a spark plug sleeve or a glow plug sleeve. For example, the integral ignition plug sleeve extension may be an ignition plug wall that is integral with the cylinder head of the engine 12 and defines a bore through which the ignition device extends. The engine 12 may include a reciprocating or piston engine (e.g., internal combustion engine). In certain embodiments, the engine 12 includes a spark-ignition engine or a compression-ignition engine. The engine 12 may include a natural gas engine, diesel engine, or dual fuel engine. The engine 12 may be a two-stroke engine, three-stroke engine, four-stroke engine, five-stroke engine, or six-stroke engine. The engine 12 may also include any number of cylinders (e.g., 1-24 cylinders or any other number of cylinders) and associated piston and liners, where the cylinders and/or the pistons may have a diameter of between approximately 10-30 centimeters (cm), 15-25 cm, or about 22 cm.

The power generation system 10 includes the engine 12, a turbocharger 14, and an electrical generator 16. Depending on the type of engine 12, the engine receives a gas and/or liquid fuel 18 (e.g., diesel, natural gas, syngas, coal seam gases, associated petroleum gas, etc.) or a mixture of both the fuel 18 and a pressurized oxidant 20, such as air, oxygen, oxygen-enriched air, or any combination thereof. Although the following discussion refers to the oxidant as the air 20, any suitable oxidant may be utilized with the disclosed embodiments. The fuel 18 or mixture of fuel 18 and pressurized air 20 is fed into the engine 12. The engine 12 combusts the mixture of fuel 18 and air 20 to generate hot combustion gases, which in turn drive a piston (e.g., reciprocating piston) within a cylinder liner. In particular, the hot combustion gases expand and exert a pressure against the piston that linearly moves the piston from a top portion to a bottom portion of the cylinder liner during an expansion stroke. The piston converts the pressure exerted by the combustion gases (and the piston's linear motion) into a rotating motion (e.g., via a connecting rod and a crankshaft coupled to the piston). The rotation of the crankshaft drives the electrical generator 16 to generate power. In certain embodiments, exhaust from the engine 12 may be provided to the turbocharger 14 and utilized in a compressor portion of the turbocharger 14, thereby driving a turbine of the turbocharger 14, which in turn drives a compressor to pressurize the air 20. In some embodiments, the power generation system 10 may not include all of the components illustrated in FIG. 1. In addition, the power generation system 10 may include other components not shown in FIG. 1 such as control components and/or heat recovery components. In certain embodiments, the turbocharger 14 may be utilized as part of the heat recovery components. Further, the system 10 may generate power ranging from 10 kW to 10 MW. Besides power generation, the system 10 may be utilized in other applications such as those that recover heat and utilize the heat (e.g., combined heat and power applications), combined heat, power, and cooling applications, applications that also recover exhaust components (e.g., carbon dioxide) for further utilization, gas compression applications, and mechanical drive applications. The integral ignition plug sleeve extension, in accordance with the present disclosure, will be described in detail below with reference to later figures.

Figure 2:
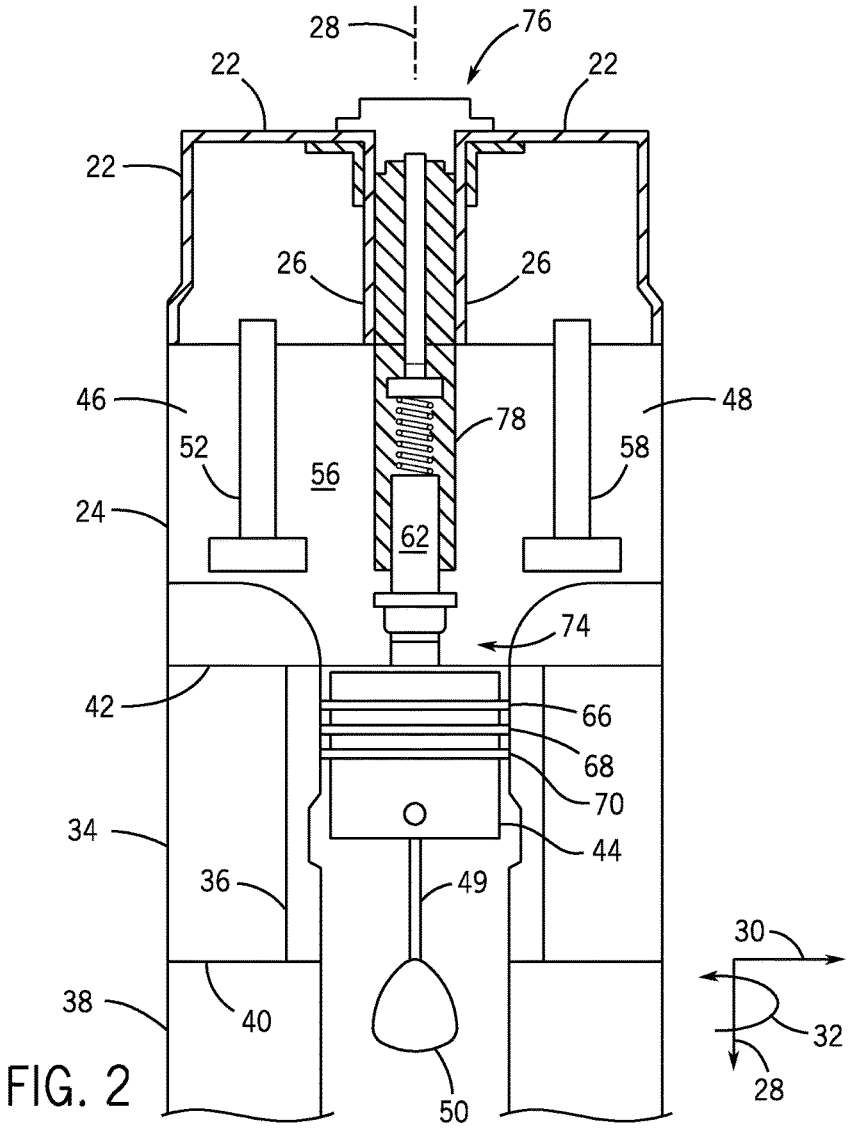
FIG. 2 is a cross-sectional side view of an embodiment of a reciprocating or piston engine of the engine driven power generation system of FIG. 1 having a cylinder head cover (e.g., coupled to the cylinder head including an integral ignition plug sleeve extension)

FIG. 2 is a cross-sectional side view of an embodiment of a reciprocating or piston engine 12 of the engine driven power generation system 10 of FIG. 1 having cylinder head cover 22 coupled to the cylinder head 24, including an integral ignition plug sleeve extension 26. In the following discussion, reference may be made to longitudinal axis or direction 28, a radial axis or direction 30, and/or a circumferential axis or direction 32 of the engine 12. As mentioned above, in certain embodiments, the engine 12 may include multiple cylinders (e.g., 2, 4, 6, 8, 10, 12, 14, 16, 18, 20, 22, or 24 cylinders). The engine 12 includes a cylinder 34 having the cylinder liner 36, a crankcase 38 coupled to a bottom end 40 of the liner 36 and the cylinder 34, the cylinder head 24 coupled to a top end 42 of the liner 36 and the cylinder 34, a piston 44 disposed in a cavity 56 within the liner 36, and a connecting rod 49 coupled to the piston 44 within the liner 36 and to a crankshaft 50 within the crankcase 38. The cylinder head 24 includes an intake port 46 for receiving air or a mixture of fuel and air and an exhaust port 48 for discharging exhaust from the engine 12. An intake valve 52, disposed within the cylinder head 24 and the intake port 46, opens and closes to regulate the intake of air or the mixture of fuel and air into the engine 12 into a cavity 56 above the piston 44. An exhaust valve 58, disposed within an exhaust port 48, opens and closes to regulate discharge of the exhaust from the engine 12. In certain embodiments (e.g., spark-ignition engine), a spark plug 62 extends through a portion of the cylinder head 24 and interfaces with cavity 56 where combustion occurs. In some embodiments (e.g., compression-ignition engine), the spark plug is absent (or is replaced with a glow plug) and ignition occurs primarily due to compression of the mixture of air and fuel.

The piston 44 may include a plurality of rings 64, including a first ring 66, a second ring 68, and a third ring 70. The first and second rings 66, 68 act as seals. The third ring 70 regulates the consumption of engine oil. Opening of the intake valve 52 enables a mixture of fuel and air to enter the cavity 56 above the piston 44 as indicated by arrow 74. With both the intake valve 52 and the exhaust valve 58 closed and the piston 44 near top dead center (TDC) (i.e., position of piston 44 furthest away from the crankshaft 50, e.g., near the top end 42 of the liner 36 or the cylinder 34), combustion of the mixture of air and fuel occurs due to spark ignition (in other embodiments due to compression ignition). Hot combustion gases expand and exert a pressure against the piston 44 that linearly moves the position of the piston 44 from a top portion (e.g., at TDC) to a bottom portion of the cylinder liner 36 (e.g., at bottom dead center (BDC) in direction 28, which is the position of the piston 44 closest to the crankshaft 50, e.g., near the bottom end 40 of the liner 36 or the cylinder 34) during an expansion stroke. The piston 44 converts the pressure exerted by the combustion gases (and the piston's linear motion) into a rotating motion (e.g., via the connecting rod 49 and the crank shaft 50 coupled to the piston 44) that drives one or more loads (e.g., electrical generator 16). During the exhaust stroke, the piston 44 returns from BDC to TDC, while the exhaust valve 58 is open to enable exhaust to exit the engine 12 via the exhaust port 48.

As described above, the cylinder head cover 22 may be integral with the ignition plug sleeve extensions 26 and may be coupled to the cylinder head 24. The cylinder head cover 22 and the ignition plug sleeve extension 26 may be cast from an aluminum alloy or other metals. The cylinder head cover 22 and the ignition plug sleeve extension 26 may be formed into an integral piece. In some embodiments, a portion of an inner annular wall 76 may extend into the cylinder head 24. The inner annular wall 76 may be partially defined by the ignition plug sleeve extension 26 of the cylinder head cover 22. The inner annular wall 76 may be centrally disposed around the longitudinal axis 28 of the spark plug 62. An ignition plug sleeve 78 may be disposed around the spark plug 62 and may interface with the plug sleeve extension 26 that is integrated into the cylinder head cover 22. The cylinder head cover 22 components may be further understood as described in FIGS. 3-4.

Figure 3:
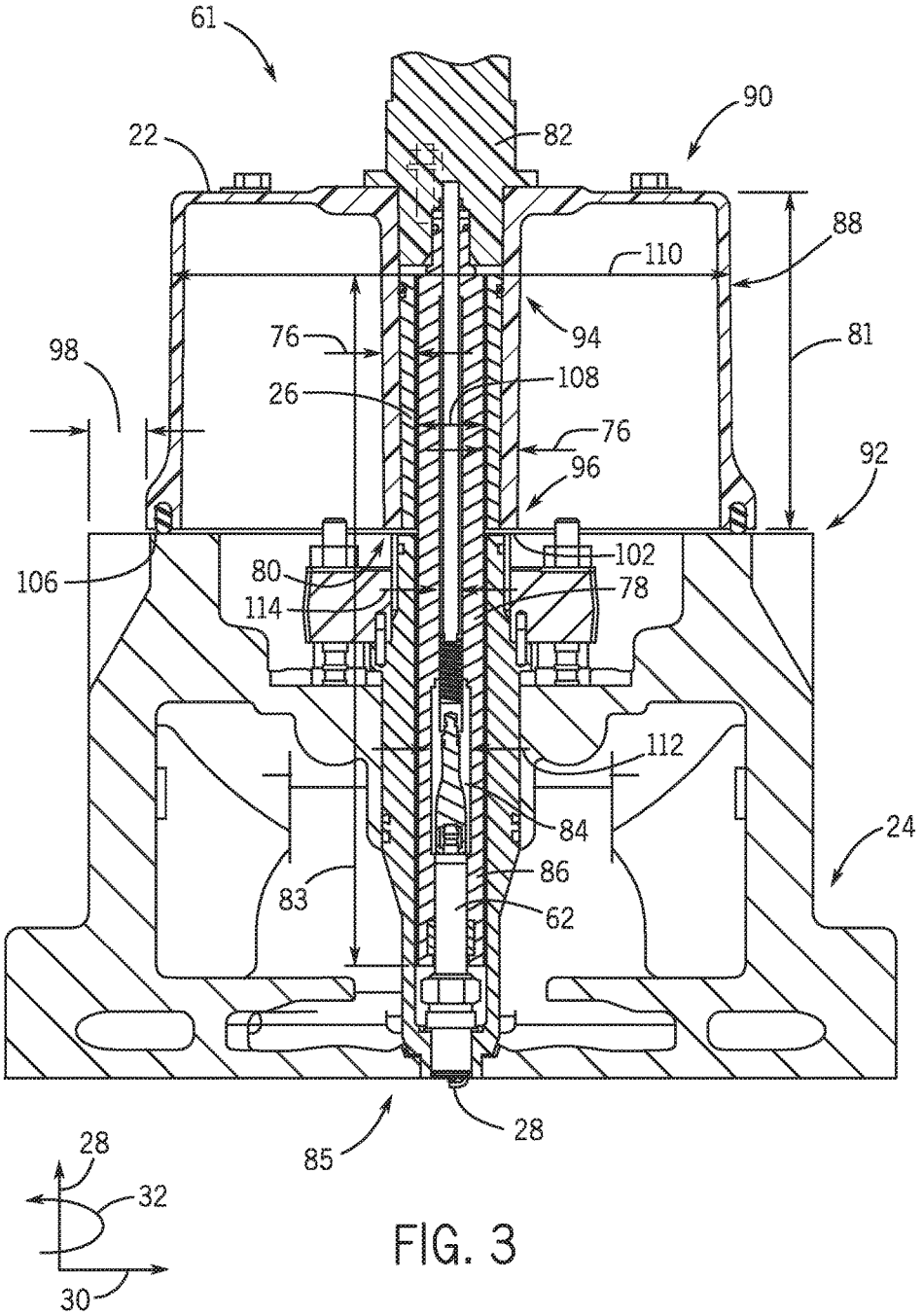
FIG. 3 is a partial cross-sectional side view of an embodiment of a reciprocating or piston engine of the engine driven power generation system of FIG. 1 having a cylinder head cover disposed on a cylinder head coupled to a cylinder.
Figure 4:
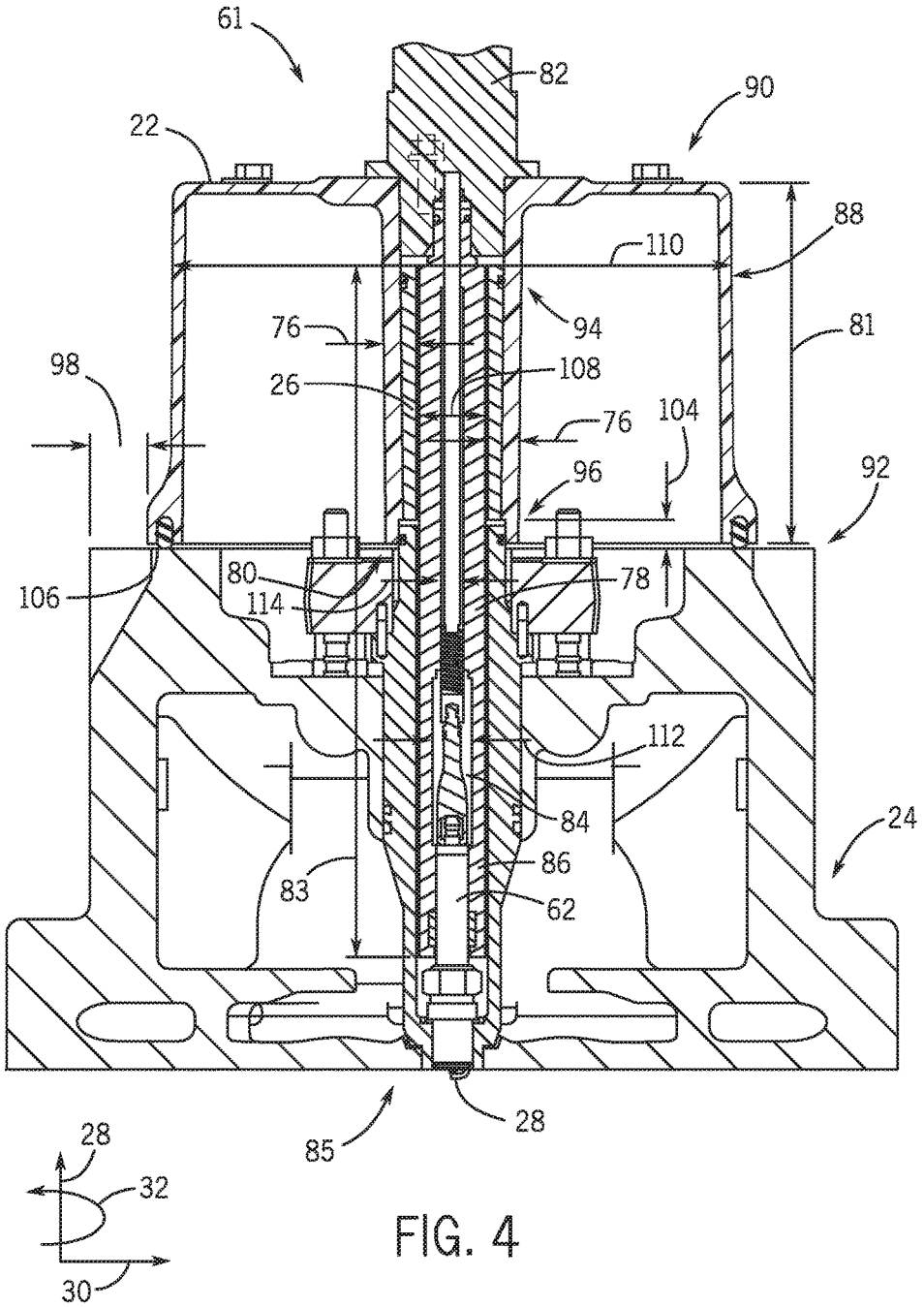
FIG. 4 is a partial cross-sectional side view of another embodiment of a reciprocating or piston engine of the engine driven power generation system of FIG. 1 having a cylinder head cover disposed on a cylinder head coupled to a cylinder.

FIGS. 3-4 depict an ignition plug assembly 61 disposed within the cylinder head cover 22. FIGS. 3 and 4 illustrate a perspective view of embodiments of the cylinder head cover 22 disposed on the cylinder head 24. As depicted, the ignition plug assembly 61 may include the spark plug 62, a coil 82, the ignition plug sleeve 78 and the integral plug sleeve extension 26. The ignition plug sleeve 78 and the integral plug sleeve extension 26 may directly contact each other to form an interface 80. The ignition plug sleeve 78 and the integral plug sleeve extension 26 may directly contact each other within the cylinder head 24. The inner annular wall 76 may be formed within the cylinder head cover 22 such that a portion of the spark plug 62 is housed within the cylinder head cover 22. The spark plug 62 may include a shell 84 surrounded by an insulator 86. The insulator 86 may be glazed to increase its resistance to cracks that may form over time. The insulator 86 may include a high grade ceramic material, or other suitable materials. The insulator may extend along the longitudinal axis 28 to surround the spark plug 62 and the integral plug sleeve extension 26.

The cylinder head 24 may include a plurality of openings. For example, the openings (e.g., fastener openings such as bolt openings) may be utilized to couple the cylinder head 24 to other components of the engine 12, such as a cylinder or block or engine block, a valve cover, conduits, etc. The cylinder head 24 may also include openings for housing or directing components of the engine 12 through the cylinder head 24 for access to internal components of the cylinder head 24. For example, a central opening 85 (e.g., ignition plug opening or bore) is included in the cylinder head 24 for receiving the spark plug 62. The central opening 85 is defined by the inner annular walls 76, embedded in the cylinder head 24. The central opening 85 may be a substantially cylindrical bore.

In some embodiments, the central opening 85 may include two or more cylindrical portions (e.g., bores), one on top of the other, each separated by a generally flat surface (e.g., an axially facing ring or annular shoulder) extending in the circumferential direction 32 about the longitudinal axis 28 extending through the central opening 85. These flat surfaces may be included for interfacing with the spark plug 62, such that the spark plug 62 may fit into the central opening 85 and surfaces of the spark plug 62 may rest against the flat surfaces (e.g., annular shoulder). Put differently, the central opening 85 may include a number of bores, one stacked on top of another, each with different diameters, where the lowest bore (e.g., the bore closest to a bottom surface 43 of the cylinder head 24) has the smallest diameter, and each bore successively increases in diameter upwards from the bottom surface 43. A first bore portion may be defined by a first inner diameter 112, and a second bore portion may define a second inner diameter 114. In some embodiments, the first diameter 112 is greater than the first bore portion. The central opening 85 may have a first bore portion (e.g., with the first inner diameter 112) disposed proximate the bottom surface 43, where the first bore portion includes threads for threadably engaging with threads on the spark plug 62. Accordingly, the first bore may retain the spark plug 62 within the central opening 85. Above the first bore, a second bore portion may be disposed with a second diameter larger than the first diameter of the first bore. Above the second bore, a third bore may be disposed with a third diameter larger than the second diameter of the second bore and the first diameter of the first bore. The spark plug 62 may be sized such that it fits into the various bores.

The cylinder head cover 22 may include an outer wall 88 extending between a first end 90 and a second end 92 of the cylinder head cover 22. The first end 90 and the second end 92 may be disposed perpendicular to the longitudinal axis 28 of the spark plug 62. The second end 92 of the cylinder head cover 22 may form an interface with the cylinder head 24. The ignition plug sleeve extension 26 may include a third end 94 and a fourth end 96. The third end 94 and the fourth end 96 may be disposed perpendicular to the longitudinal axis 28 of the spark plug 62. The second end 92 may and the fourth end 96 may interface (e.g., abut) each other within in the cylinder head 24 along a plane 98 extending crosswise (e.g., perpendicular) to the longitudinal axis 28 that extends through the inner annular wall 76. The cylinder head cover 22 may include the outer wall 88 which extends between the first end 90 and the second end 92 in a direction 100 (e.g., longitudinal direction 28) that has a first length 81. In some embodiments, a length (e.g., second length 83) of the ignition plug sleeve 26 may be equal to the first length. Alternatively, the second length 83 may be greater than the first length 81.

The second end 92 and the fourth end 96 may abut at the interface 80 in the direction 28 in the cylinder head cover 22 or within the cylinder head 24. For example, the interface 80 may be formed at a first location 102 within the cylinder head cover 22, or the interface 80 may be formed at a second location 104 within the cylinder head 24, as shown in FIG. 4. Though two locations (e.g., 102, 104) are described, the interface 80 may be formed at any location within the direction 28. Within the cylinder head 24, a seal 106 may be disposed between the interface 80 between the second end 92 and the fourth end 96. The seal 106 may include a ring seal (e.g., an O-ring seal, O-ring boss seal), a slip joint with an O-ring, or any other suitable seal to reduce or minimize leakage of hot gases. The inner annular walls 76 may define a first diameter 108, and the outer walls 88 of the cylinder head cover 22 may define a second diameter 110. In some embodiments, the ratio of the second diameter 110 to the first diameter 108 may be 10:1 to 1:1, 8:1 to 2:1, 6:1 to 3:1, and all ranges therebetween.

Figure 5:
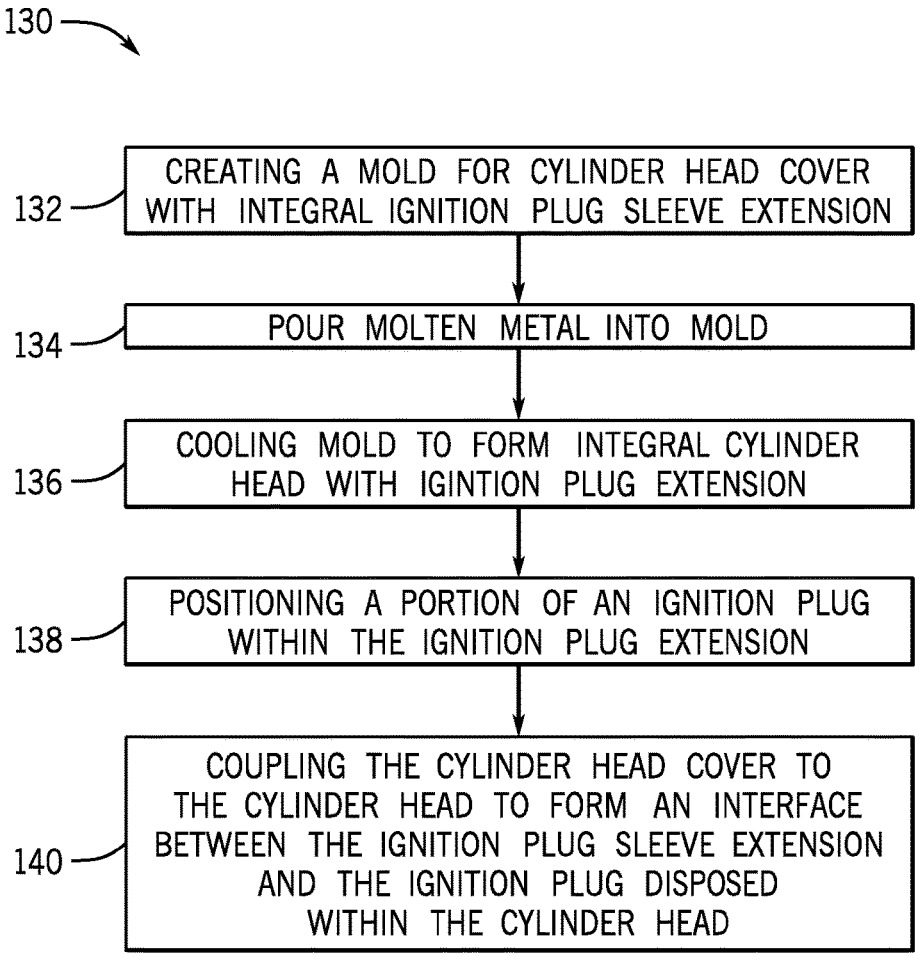
FIG. 5 is a flow chart illustrating an embodiment of a method for manufacturing the cylinder head cover with the integral ignition plug sleeve extension.

FIG. 5 is a flow chart illustrating an embodiment of a method 130 for forming the cylinder head cover 22 with the integral ignition plug sleeve extension 26. The method 130 may include creating a mold for the cylinder head cover 22 with the integral ignition plug sleeve extension 26 (block 132) out of a light weight materials, such as a suitable die cast alloy (e.g., die cast aluminum). The method 130 may include pouring molten metal into a mold (block 134) to mold the integral cylinder head cover 22 and ignition plug sleeve extension 26 into one piece. The method 130 may include cooling the mold to form the one piece cylinder head cover 22 (block 136). The method 130 may include positioning a portion of the spark plug 62 within the ignition plug sleeve 78 (block 138). The portion of the spark plug 62 that may be positioned within the ignition plug sleeve 78 may vary, though a substantial portion (e.g., more than 50%, more than 70%, more than 90%, more than 95%) of the spark plug 62 is disposed within the ignition plug sleeve 78. The method 130 may include coupling the cylinder head cover 22 to the cylinder head 24 to form an interface 80 between the ignition plug sleeve extension 26 and the spark plug 62 disposed within the cylinder head 24 (block 140).

Technical effects of the disclosed embodiments include systems for components of reciprocating engines 12 and, more specifically, the cylinder head cover 22 of the reciprocating engine 12. Embodiments of the present disclosure include the cylinder head 24 and the integral ignition plug sleeve extension 26 (e.g., as a single structure with the cylinder head 24) for receiving the spark plug 62 (e.g., ignition plug or glow plug) of the reciprocating engine 12. The integral ignition plug sleeve extension 26 of the cylinder head 24 may define the inner annular wall 76 of the cylinder head cover 22 which is centrally located within the cylinder head cover 22. The inner annular wall may define an opening or bore in which the spark plug 62 (e.g., spark plug or glow plug) rests. In accordance with embodiments of the present disclosure, a portion of the inner annular wall 76 extends into the cylinder head 24. The disclosed embodiments reduce the number of parts required for the cylinder head 24, thereby simplifying the manufacturing process. The disclosed embodiments may also reduce leakage paths for hot gases and may improve sealing between the cylinder head 24 and the cylinder head cover 22.

This written description uses examples to disclose the subject matter, including the best mode, and also to enable any person skilled in the art to practice the subject matter, including making and using any devices or systems and performing any incorporated methods. The patentable scope of the subject matter is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising: a cylinder head for a reciprocating engine; and a cylinder head cover configured to couple to the cylinder head, wherein the cylinder head cover comprises an ignition plug sleeve extension configured to house a portion of an ignition plug within the cylinder head cover, and the ignition plug sleeve extension is integral to the cylinder head cover, wherein the ignition plug sleeve extension comprises a first lower end and an ignition plug sleeve comprises a second upper end, and wherein the first lower end and the second upper end are vertically disposed directly opposite of each other and directly contact each other at a horizontal interface, and the first upper end and the second lower end is collinear.

2. The system of claim 1, wherein the cylinder head cover and the ignition plug sleeve extension are cast.

3. The system of claim 1, wherein the ignition plug sleeve extension defines an inner annular wall of the cylinder head cover.

4. The system of claim 3, wherein the inner annular wall is centrally located within the cylinder head cover.

5. The system of claim 4, wherein a portion of the inner annular wall extends into the cylinder head.

6. The system of claim 3, wherein the inner annular wall defines a first bore portion having a first inner diameter and a second bore portion having a second inner diameter, and the first inner diameter is greater than the second inner diameter.

7. The system of claim 1, wherein the cylinder head comprises the ignition plug sleeve, and the ignition plug sleeve extension and ignition plug sleeve directly contact each other.

8. The system of claim 7, wherein the horizontal interface occurs outside the cylinder head cover.

9. The system of claim 7, wherein the horizontal interface occurs inside the cylinder head cover.

10. The system of claim 1, comprising the reciprocating engine having the cylinder head and the cylinder head cover.

11. A system, comprising: a cylinder head cover configured to couple to a cylinder head of a reciprocating engine, wherein the cylinder head cover comprises an ignition plug sleeve extension that forms an inner annular wall within the cylinder head cover that is configured to house a portion of an ignition plug within the cylinder head cover, and the ignition plug sleeve extension and the cylinder head cover comprise a single piece, wherein the ignition plug sleeve extension comprises a first lower end, an ignition plug sleeve comprises a second upper end, and wherein the first lower end and the second upper end are vertically disposed directly opposite of each other and directly contact each other at a horizontal interface, and the first lower end and second lower end is collinear.

12. The system of claim 11, wherein the cylinder head cover and the ignition plug sleeve extension are cast.

13. The system of claim 11, wherein the inner annular wall is centrally located within the cylinder head cover.

14. The system of claim 11, wherein the cylinder head cover comprises an outer wall having a first length extending between a third end and a fourth end, the fourth end being configured to interface with the cylinder head, the ignition plug sleeve extension comprises a second length, and the first and second lengths are equal.

15. The system of claim 11, wherein the cylinder head cover comprises an outer wall having a first length extending between a third end and a fourth end, the fourth end being configured to interface with the cylinder head, the ignition plug sleeve extension comprises a second length, and the second length is greater than the first length.

16. The system of claim 11, wherein the inner annular wall forms an annular shoulder.

17. The system of claim 11, wherein cylinder head cover and the ignition plug sleeve extension are made of an aluminum alloy.

18. A method, comprising; casting a cylinder head cover for coupling to a cylinder head, wherein the cylinder head cover comprises an ignition plug sleeve extension configured to house a portion of an ignition plug within the cylinder head cover, and the ignition plug sleeve extension is integral to the cylinder head cover; and coupling the cylinder head cover to the cylinder head to form a horizontal interface between a first lower end of the ignition plug sleeve extension and a second upper end of an ignition plug sleeve disposed within the cylinder head so that the first lower end is directly opposite from the second upper end in a vertical direction and the first lower end contacts the second upper end, the first upper end and the second lower end is collinear.

19. The method of claim 18, disposing a portion of an ignition plug within the ignition plug sleeve extension.

20. The method of claim 18, wherein the horizontal interface occurs outside the cylinder head cover.

* * * * *